United States Patent [19]

Ball

[11] 4,018,479

[45] Apr. 19, 1977

[54] OFFICE CHAIR

[75] Inventor: Douglas C. Ball, Senneville, Canada

[73] Assignee: Sunar Limited, Waterloo, Canada

[22] Filed: Nov. 3, 1975

[21] Appl. No.: 628,682

[52] U.S. Cl. ..... 297/455; 297/239; 297/441; 297/457; 297/DIG. 2

[51] Int. Cl.[2] ..... A47C 7/02

[58] Field of Search ..... 297/440, 441, 445, 452, 297/455, DIG. 2, 458, 459, 460, 457, 239

[56] References Cited

UNITED STATES PATENTS

| | | | |
|---|---|---|---|
| 2,605,819 | 8/1952 | Le Tourneau | 297/459 |
| 3,037,814 | 6/1962 | Gardner et al. | 29/460 X |
| 3,159,428 | 12/1964 | Schier | 297/455 X |
| 3,230,011 | 1/1966 | Propst | 297/441 |
| 3,264,034 | 8/1966 | Lawson | 297/458 X |
| 3,319,999 | 5/1967 | Lieberman et al. | 297/452 X |
| 3,441,315 | 4/1969 | Paes et al. | 297/452 X |
| 3,758,159 | 9/1973 | Morris | 297/460 X |

*Primary Examiner*—Marion Parsons, Jr.
*Assistant Examiner*—Peter A. Aschenbrenner
*Attorney, Agent, or Firm*—William R. Nolte

[57] ABSTRACT

A office chair having an endless, rigid frame of metal supporting a seat and backrest in which the metal frame has a generally U-shaped configuration with curved surfaces facing a viewer and with engaged, complementary portions of the frame, seat and backrest not only accurately locating the components relative to each other for assembly, but also concealing the unfinished edged of upholstery material and maintaining it tightly and at the same time covering portions of the frame to conceal its massiveness.

3 Claims, 9 Drawing Figures

OFFICE CHAIR

This invention relates to chairs and particularly to swivel type office chairs.

Office chairs frequently include a metal frame which usually is made of metal having a tubular cross section. Unless tubular material with a large cross-sectional dimension is used, the frame will be flexible, particularly between portions supporting the seat and portions supporting the backrest. It is important that the frame be rigid and that it maintain its rigidity to firmly establish the angle between the backrest and seat portion since an angular change of as little as 1° can affect seating comfort. To obtain this rigidity with tubular material the frame becomes extremely massive in appearance which often is undesirable.

It is an object of the invention to provide a chair incorporating a metal frame which is rigid.

It is another object of the invention to provide a chair with such a rigid frame in which the body support members are so arranged relative to the frame that they conceal the frame's massiveness.

Still another object of the invention is to provide a chair in which body support portions in the form of a seat and backrest member are readily and accurately positioned relative to the frame.

The chair embodying the invention incorporates a metal frame forming the perimeter of the seat and backrest portions and is of endless construction. The frame has a U-shaped cross section in which the outer surfaces are uniformally curved and the curved portions are exposed to a viewer of the chair and face in the general direction of an occupant of the chair. The frame and body support portions are formed with complementary support and mounting surfaces which permit accurate positioning of the body support portions relative to the frame and at the same time form a cavity for concealing upholstering covering the body support portions. The body support portions are formed with an outer lip adjacent to the frame such that the lip extends generally tangentially of the curved surface to conceal a portion of the frame from a viewer or occupant.

Figure 1:
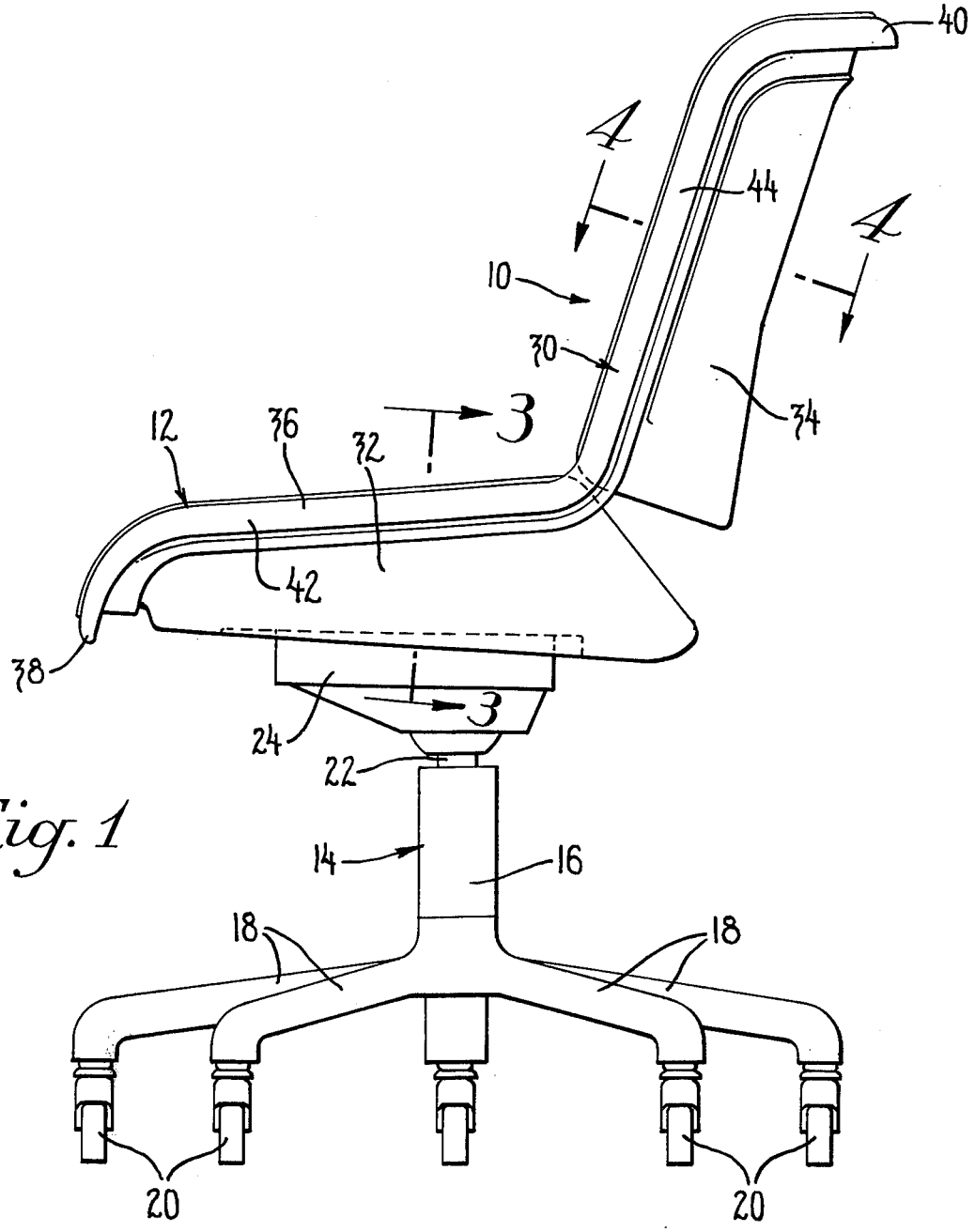
FIG. 1 is a side elevation of a chair embodying the invention.

Referring to FIG. 1 a chair embodying the invention is indicated generally at 10 which includes a seating portion 12 and a base 14 for supporting the seating portion in elevated position relative to the floor. The base 14 includes a vertically extending pedestal 16 which has five radially extending legs 18, the outer ends of which are fitted with conventional casters 20. The pedestal 16 rotatably receives a shaft 22 permitting the seating portion 12 to swivel relative to the base 14. The upper end of the shaft 22 is provided with a conventional spring type tilt mechanism 24 which is fastened to the seating portion 12 to permit limited tilting of the seat portion 12 relative to the base 14.

The seat portion 12 includes a frame 30 and body support portions in the form of a seat 32 and a backrest 34. The frame 30 is cast or molded of metal such as aluminum. The frame 30 has generally parallel side members 36 joined together by a forward cross member 38 and a rear or top cross member 40. The side members 36 each have a seat supporting portion or part 42 and a backrest supporting portion or part 44 disposed at a fixed angle relative to each other. The cross member 38 and 40 are offset downwardly and rearwardly, respectively, from the associated seat and backrest supporting portions. The frame 30 is of continuous, endless construction surrounding the front and sides of the seat 32 and top and sides of the backrest 34.

Figure 3:
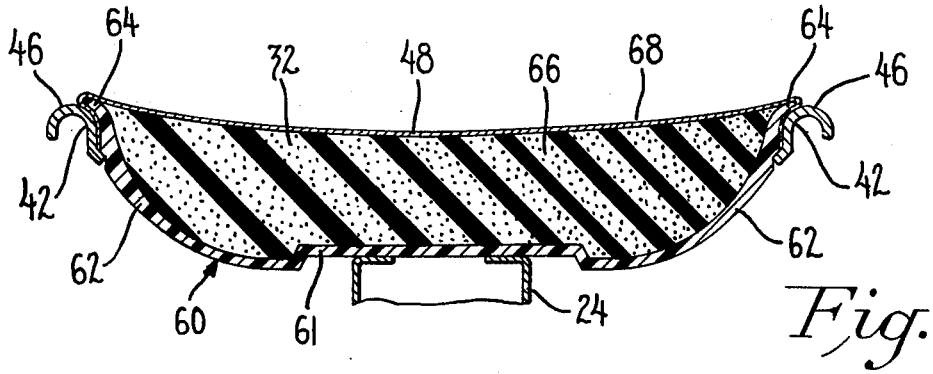
FIG. 3 is a cross-sectional view taken generally on line 3—3 in FIG. 1.
Figure 2:
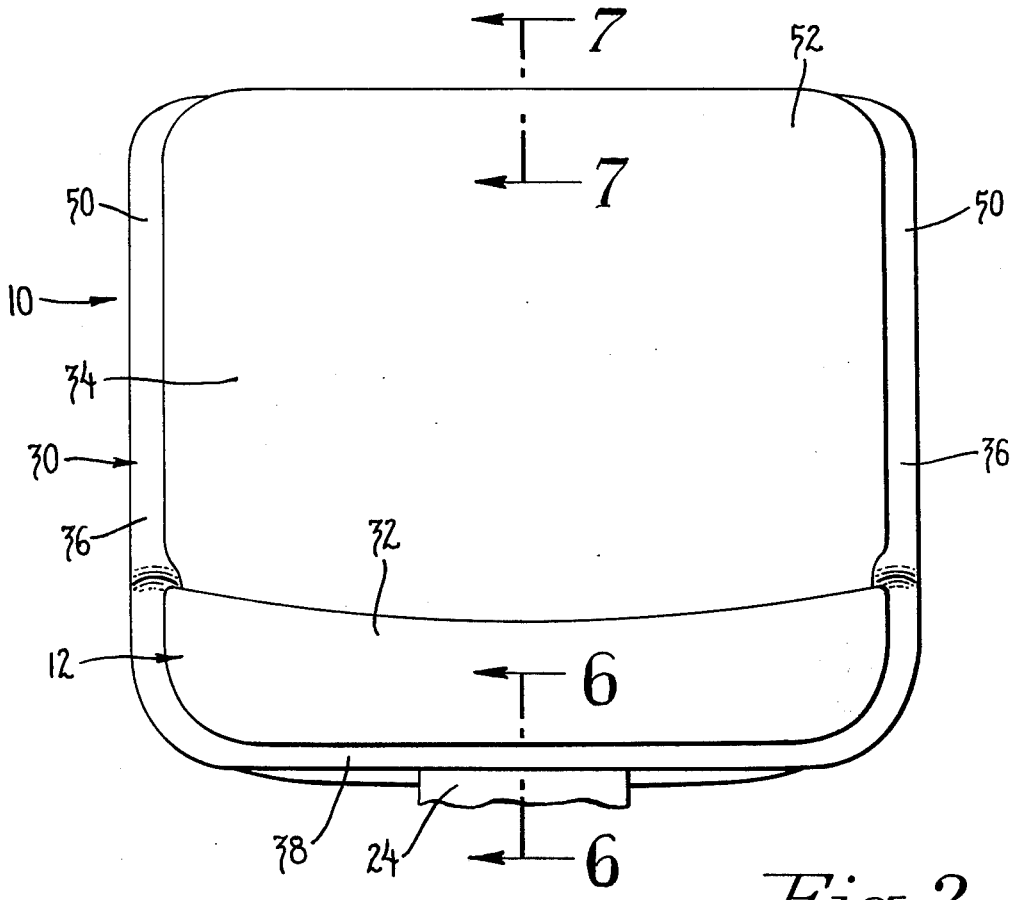
FIG. 2 is a front elevation of the chair shown in FIG. 1 with the bottom cut away.

The entire metal frame 30 is channel shaped or U-shaped in cross section with the cross section varying throughout various portions of the frame. As best seen in FIGS. 3 and 5 the seat supporting portions 42 of the frame 30 are U-shaped to form a curved outer surface 46 which faces upwardly in the same direction as a body supporting surface 48 of the seat 32 with the open portion of the U facing downwardly. The backrest supporting portions 44 seen in FIG. 4 are shaped similarly to the seat supporting portions 42 with curved surfaces 50 facing forwardly in the direction of the body supporting surface 52 of the backrest 34 and the open portion of the U facing rearwardly of the chair.

Figure 6:
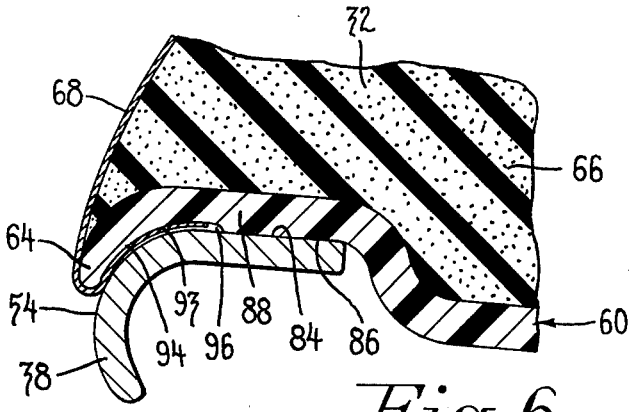
FIG. 6 is a sectional view at an enlarged scale taken on line 6—6 in FIG. 2.

The cross section of the forward cross member 38 is best seen in FIG. 6 in which the generally U-shaped cross section has its outer curved surface 54 facing forwardly of the chair and the open portion of the U facing rearwardly. The top cross member 40 in FIG. 7 has its curved surface 56 facing upwardly. The open portion of the U-shaped cross section faces downwardly and is provided with a flat surface 58 which forms a convenient hand hold at the upper rear of the chair for moving it when it is not occupied.

Referring now to FIG. 3 the seat includes a housing 60 made of a relative rigid material such as plastic. The housing 60 has a backside or generally horizontal wall 61 merging with curved side walls 62. The side walls 62 terminate in edges or lips 64. The cavity formed in the housing 60 is filled with a resilient cushioning material such as beaded foam indicated at 66. The foam cushion 66 is covered with upholstery material 68 which extends over the lips 64.

Figure 4:
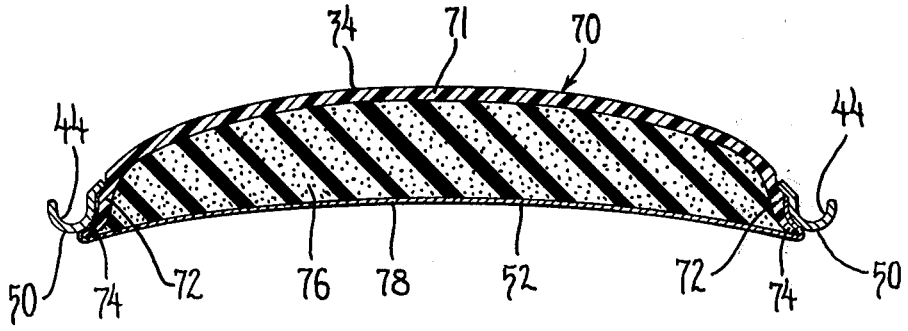
FIG. 4 is a cross-sectional view taken generaly on line 4—4 in FIG. 1.
Figure 5:
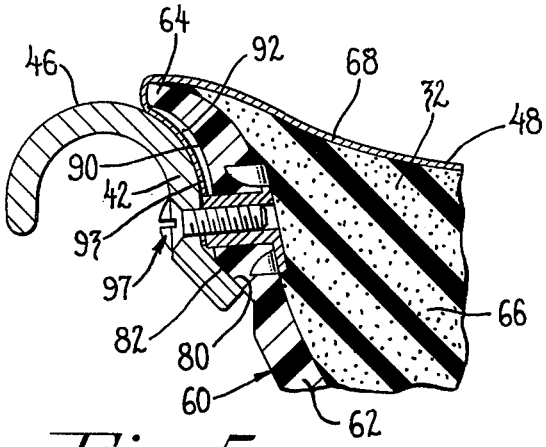
FIG. 5 is an enlarged view of the sectional portion shown in FIG. 3.

As seen in FIG. 4, the backrest 34 is constructed in a manner similar to the seat 32 in that it has a backside or vertical wall 71 and a housing 70 with curved side walls 72 terminating in lips or edges 74. The housing 70 is also filled with the foam cushioning material 76 and covered with upholstery material 78 extending over the lips 74.

The configuration of the frame 30 and the configuration of the seat 32 and backrest 34 cooperate to support and accurately locate the frame seat and backrest. As best seen in FIGS. 3 and 5. The seat supporting portion 42 of the frame is provided with a portion having a support surface 80 extending at an angle to the U-shaped cross section. The support surfaces 80 at opposite sides of the frame 30 face in directions converging upwardly and are complementary to and abut mounting surface 82 formed on the walls 62 of the seat housing 60. Similarly the cross member 38 as seen in FIG. 6 has a portion extending from the curved surface 54 to form a support surface 84 which in this instance faces upwardly and is complementary to a mounting surface 86 formed at the forward edge wall 88 of the housing 60 in spaced relation to the lip 64.

As seen in FIG. 5, the outer surface of the seat housing 60 between the mounting surface 82 and the lip 64 is curved as indicated at 90 and is spaced from the curved surface 46 to form a cavity 92 in which unfinished edges 93 of the upholstery material 68 may be located to conceal the latter when the chair is completely assembled. Similarly, as seen in FIG. 6, the underside of the seat housing 60 between the lip 64 and the mounting surface 86 has a curved portion 94 spaced slightly from curved surface 54 to form a cavity 96 to accommodate the unfinished edge 93 of the upholstery material and conceal it from view.

When the seat 32 is being assembled to the frame 30, the complementary supporting and mounting surface 80 and 82 on the seat supporting portions 42 center the seat 32 relative to the frame 30 and the lip 64 on the curved portion at the forward edge wall 88 of the seat 32 engages the curved surface 54 of the forward cross member 38 to prevent rearward movement and accurately locate the seat assembly 32 relative to the frame 30. After the seat 32 and the frame 30 have been located relative to each other they may be fastened together by means of fasteners such as screws and fittings 97 seen in FIG. 5.

The upholstery material 68 covering the seat 32 has its edges 93 fastened to housing 60 of the seat in any conventional manner as by staples or adhesives. Before the seat is assembled to the frame 30, the upholstery at the sides of the seat will extend in spaced relationship to the curved surface 90 between the lip 64 and the edge 93 at which the upholstery is fastened to the housing 60. In the same manner, the upholstery material at the forward edge of the seat will extend from the lip 64 to the edge 93 at which the upholstery is fastened. Upon assembly of the seat 32 and frame 30, the curved surfaces 46 at the sides of the seat and the curved surface 54 at the front of the seat will tend to deflect the material closer to the curved surfaced 90 and 94, respectively to insure that the upholstery material is maintained tightly on the housing 60, particularly adjacent to the lip 64.

As seen from a comparison of FIGS. 3 and 4 the backrest 34 has a configuration adjacent to its opposite sides which is the same as that found at the sides of seat 32. The sides of the backrest 34 are fitted relative to the supporting portions 44 in the same manner as the sides of the seat 32 relative to their support portions 42. The upper edge of the backrest 34, however, is formed with a recess or cavity 98 which receives the top cross member 40. A lip or edge 100 is formed adjacent one side of the recess and a generally parallel wall 102 is formed in spaced relation to the lip 100. The lip 100 and the wall 102 serve to properly locate the backrest 34 relative to the frame 30 and the cavity or recess 98 receives the unfinished upholstery edge 104 and permits fastening the material to the housing 70. As in the case of the seat 32, the upholstery material on backrest 34 will extend from lip 100 to the edge 104 of the material so that the curved edge 56 of the frame will deflect the material into the cavity 98 to maintain the upholstery tightly.

To assemble the backrest 34 to the frame 30, the support surface 80 and mounting surface 82 which are identical to the surfaces at the side of the seat 32 are placed in engagement with each other to center the backrest 34. Engagement of lip 100 seen in FIG. 7 with the surface 56 will limit downward movement of the backrest 34 relative to the frame to properly locate the parts for the insertion of screws 97 such as seen in FIG. 5 into aligned, predrilled holes in the frame 30 and backrest housing 70.

Figure 7:
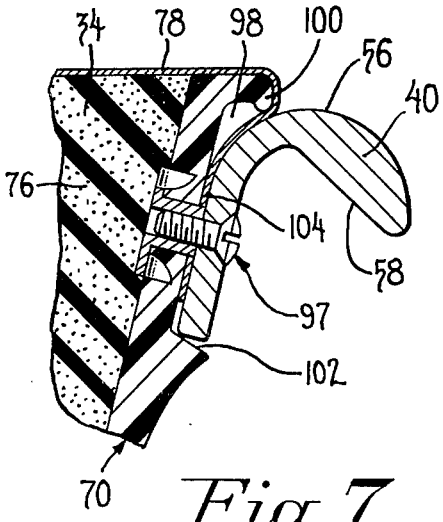
FIG. 7 is a cross-sectional view at an enlarged scale taken on line 7—7 in FIG. 2.

As will be seen from an examination of FIGS. 5, 6 and 7, the lips 64 and 74 along the sides of the seat and backrest, the lip 64 at the front of the seat and the lip 100 at the top rear of the backrest all point generally tangentially to the respective curved surfaces 46, 54 and 56 of the frame 30 and in the assembled condition of the chair serve to conceal a portion of the metallic frame 30.

Figure 8:
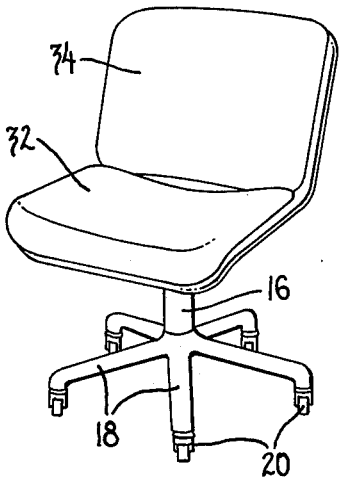
FIG. 8 is a perspective view of the office chair.
Figure 9:
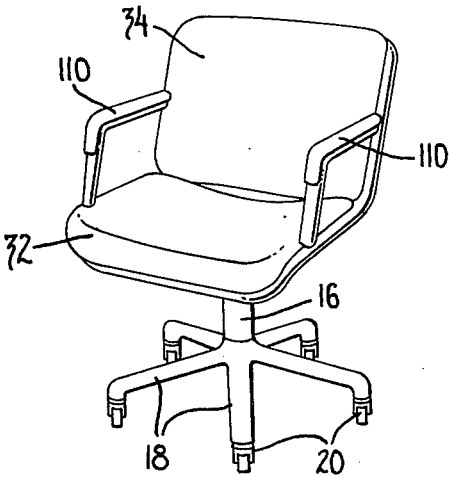
FIG. 9 is a perspective view of an office chair such as that shown in FIG. 8 but fitted with arm rests.

As seen in FIGS. 8 and 9 a chair 10 may be constructed with or without armrests 110. If armrests are desired, they may also be constructed of metal with a generally U-shaped cross section so that the open side of the U faces downwardly and rearwardly.

It will be noted that a chair has been provided in which the frame 30 has a generally U-shaped cross section which is extremely rigid and at the same time is relatively light. The curved surfaces 46, 54 and 56 seen in FIGS. 5, 6 and 7 respectively, are generally circular and are all formed on the same radius to give a pleasant appearance to the frame. The seat assembly 32 and backrest assembly 34 are firmly supported by the coaction of the support and mounting surfaces formed on the frame 30 and the housings 60 and 70 and at the same time the seat 32 and backrest 34 are very accurately located relative to the rigid frame making it possible to reduce the assembly procedure to the simple insertion of screws 97 into predrilled openings in the frame 30 and the housing 60 and 70 since the predrilled holes will be brought into accurate alignment with each other and will not require custom fitting. As a consequence, it is possible to ship large quantities of such chairs in disassembled form since the accurate alignment of parts permits easy assembly without requiring elaborate tools or skills. The configuration of the chair frame 30 is such that in the disassembled condition of the chairs, the frames 30 will snugly nest together and reduce cargo and storage space. In addition the body supporting seat 32 and backrest 34 have a configuration acting with the curves surfaces of the frame to form cavities which conceal the unfinished edges of the upholstery material and also act to maintain the upholstery material tightly. The edges of the seat and backrest engaging the frame serve to conceal a substantial portion of the frame cross section so that the small, exposed portions of the frame tend to make it look less massive.

The embodiments of the invention in which an exclusive property or privilege is claimed are defined as follows:

1. A chair comprising: a rigid frame of endless, one piece construction having generally parallel side members each having a seat supporting part and a back supporting part and parallel end members maintaining said side members in spaced apart relationship to each other, said frame being of generally U-shape cross-section having inner and outer parallel legs and a curved surface connecting portion, wherein said inner legs define the inner periphery of said frame and further include flange portions disposed at an angle to said inner leg portions, body support means having a body engaging surface, and having opposite wall portions forming first mounting sufaces projecting away from said body engaging surface for engagement with the inner legs of said frame, said wall portions including second mounting surfaces for complemental engagement with said flange portions of said inner legs, said wall portions at opposite sides of said body support means defining marginal edge lip portions spaced from said first mounting surfaces, said lip portions being in engagement with and partially overlapping said curved surface connecting portions of said frame, and wherein the major portion of said body supporting means, except for said marginal edge lip portions, lie to the side of said curved surface connecting portions of said U-shaped frame from which said legs depend.

2. In the chair as set forth in claim 1 where said body support means include a seat portion and a backrest and wherein a base is fastened to said seat portion to support said seat portion in elevated position from a floor, said base including a vertically disposed pedestal with legs extending radially therefrom.

3. A chair frame for supporting a seat and a backrest at a fixed angle to each other, said frame being of generally U-shaped cross-section defining spaced apart leg portions interconnected by a curved central portion and comprising: a pair of side members each having a seat supporting part and a backrest supporting part, a first cross member formed integrally with said seat supporting part and a second cross member formed integrally with said backrest supporting part, said first and second cross members and side members forming a continuous, endless rigid frame, said first cross member and said seat portions of said side member having their curved portions facing upwardly and their spaced apart leg portions extending downwardly, said backrest supporting portions of said side members having its curved portion facing forwardly and their spaced apart leg portions facing rearwardly and said second cross member having its curved portion facing upwardly and its leg portions extending downwardly, whereby upon stacking vertically a plurality of said frames for shipment the curved portions of one frame are received within the spaced apart legs of an adjacent frame such that said downturned leg portions of said first and second cross members preclude shifting of successive stacked frames in a fore and aft direction, and said downwardly extending legs of said side frame members in said seat supporting portion and the rearwardly extending leg portions in of side frames members in said backrest supporting portions preclude lateral shifting.

* * * * *